US012098719B2

(12) United States Patent
Ganster et al.

(10) Patent No.: US 12,098,719 B2
(45) Date of Patent: Sep. 24, 2024

(54) VAPOR INJECTION STRUCTURE FOR A COMPRESSOR

(71) Applicant: Hanon Systems, Daejeon (KR)

(72) Inventors: Pete Ganster, Plymouth, MI (US); Bradley Vernon Crenshaw, Riverview, MI (US); Steven J. Koester, Toledo, OH (US)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/171,833

(22) Filed: Feb. 21, 2023

(65) Prior Publication Data

US 2024/0280102 A1 Aug. 22, 2024

(51) Int. Cl.

| | |
|---|---|
| ***F04C 18/02*** | (2006.01) |
| ***F04C 15/06*** | (2006.01) |
| ***F04C 28/26*** | (2006.01) |
| ***F04C 29/12*** | (2006.01) |
| ***F04D 27/02*** | (2006.01) |
| ***F04D 29/66*** | (2006.01) |

(52) U.S. Cl.

CPC ..... *F04C 15/068* (2013.01); *F04C 18/0215* (2013.01); *F04C 18/0261* (2013.01); *F04C 28/26* (2013.01); *F04D 27/0238* (2013.01); *F04D 29/66* (2013.01)

(58) Field of Classification Search

CPC .. F04C 15/068; F04C 15/066; F04C 18/0215; F04C 18/0261; F04C 28/26; F04C 29/126; F04C 29/128; F04D 29/126; F04D 29/128

See application file for complete search history.

(56) References Cited

U.S. PATENT DOCUMENTS

| | | | | |
|---|---|---|---|---|
| 11,384,759 | B2 | 7/2022 | Bhatia et al. | |
| 2004/0191083 | A1* | 9/2004 | Gennami | F04C 23/008 417/310 |

(Continued)

FOREIGN PATENT DOCUMENTS

| | | | |
|---|---|---|---|
| CN | 111919028 | B | 12/2022 |
| JP | 2015129475 | A | 7/2015 |

(Continued)

OTHER PUBLICATIONS

English translation of KR20120030282 by PE2E, Apr. 29, 2024.*

*Primary Examiner* — Deming Wan

(74) *Attorney, Agent, or Firm* — Shumaker, Loop & Kendrick, LLP; James D. Miller

(57) ABSTRACT

A scroll compressor including a compression mechanism assembled with a valve assembly disposed in a housing. The compression mechanism including a fixed scroll and an orbit scroll. The fixed scroll includes a recessed pocket having a first indentation with a first injection port and a second indentation with a second injection port. A double reed structure of the valve assembly is disposed in the recessed pocket of the fixed scroll. The double reed structure includes a first reed configured to selectively permit a flow of a fluid through the first injection port and a second reed configured to selectively permit a flow of a fluid through the second injection port. The valve assembly further includes a valve member disposed adjacent the reed structure and a valve gasket disposed between the valve member and a portion of the housing.

16 Claims, 6 Drawing Sheets

(56) References Cited

U.S. PATENT DOCUMENTS

| | | | | |
|---|---|---|---|---|
| 2015/0125330 | A1* | 5/2015 | Komura | F04C 15/062 418/55.1 |
| 2015/0176585 | A1* | 6/2015 | Sun | F04C 29/128 137/493 |
| 2016/0084250 | A1 | 3/2016 | Imai et al. | |
| 2021/0285445 | A1 | 9/2021 | Bhatia et al. | |

FOREIGN PATENT DOCUMENTS

| | | | | | |
|---|---|---|---|---|---|
| KR | 20050028218 | A | | 3/2005 | |
| KR | 20120030282 | A | * | 9/2010 | F04C 29/00 |

* cited by examiner

VAPOR INJECTION STRUCTURE FOR A COMPRESSOR

FIELD

The disclosure relates to a compressor, and more particularly to a vapor injection structure for a compressor.

BACKGROUND

As is commonly known, vehicles typically include a heating, ventilating, and air conditioning (HVAC) system. In certain applications, a scroll compressor is employed for compressing a refrigerant circulated through a refrigerant circuit of the HVAC system. More specifically, such refrigerant circuits may be configured for use with a vapor injection scroll compressor that utilizes two different inputs of the refrigerant at different pressures and/or temperatures for optimizing the capacity of the vapor injection scroll compressor in comparison to single input scroll compressors. This is typically achieved by returning a portion of the refrigerant back towards the vapor injection scroll compressor after initially exiting the compression chambers of the vapor injection scroll compressor. Depending on the configuration of the refrigerant circuit, the returned refrigerant may be expanded via a corresponding expansion element, subcooled via a corresponding heat exchanger, or separated via a cyclone separator or the like, as well as any combinations thereof, prior to reentry back into the vapor injection scroll compressor to ensure that the returned refrigerant has the desired characteristics for the given application.

Generally, scroll compressors include a fixed scroll that remains stationary and an orbiting scroll that is nested relative to the fixed scroll and configured to orbit relative to the fixed scroll. The orbiting motion of the orbiting scroll, as well as the similar spiral shape of each of the fixed scroll and the orbiting scroll, continuously forms corresponding pairs of substantially symmetric compression chambers between the fixed scroll and the orbiting scroll. Each pair of the compression chambers is typically symmetric about a centralized discharge port of the vapor injection scroll compressor. Refrigerant typically enters each of the compression chambers via one or more inlet ports formed adjacent a radially outmost portion of the fixed scroll and then the orbiting motion of the orbiting scroll relative to the fixed scroll results in each of the compression chambers progressively decreasing in volume such that the refrigerant disposed within each of the compression chambers progressively increases in pressure as the refrigerant approaches the radially central discharge port.

The vapor injection scroll compressor is distinguished from traditional scroll compressors by injecting the returned refrigerant into each of the symmetrically formed compression chambers at a corresponding intermediate position disposed radially between the outwardly disposed inlet ports and the centrally disposed discharge port of the fixed scroll. Due to the presence of the pairs of the symmetric compression chambers between the cooperating scrolls, it is beneficial to introduce the returned refrigerant at two different injection openings that are similarly substantially symmetrically disposed relative to the centrally disposed discharge port such that each of the paired compression chambers receives a flow of the returned refrigerant at similar positions within the compression process. The injected refrigerant accordingly enters each of the compression chambers at a position corresponding to a region of the fixed scroll repeatedly subjected to a pressure of the radially inwardly flowing refrigerant that is generally intermediate the suction pressure formed at the inlet ports and the discharge pressure formed at the discharge port of the fixed scroll. The injected refrigerant originates from an injection chamber of the vapor injection scroll compressor configured to receive the returned refrigerant therein prior to reintroduction back into the compression chambers.

Additionally, the continuous orbiting of the orbiting scroll relative to the fixed scroll results in each of the injection openings formed in the fixed scroll being subjected to a variable pressure during each orbit of the orbiting scroll based on whether a corresponding portion of the orbiting scroll has passed by the corresponding injection opening with respect to each orbit cycle. It is therefore necessary for each of the injection openings of the fixed scroll to be associated with a corresponding check valve for ensuring that the returned refrigerant is injected into the corresponding compression chamber in a single flow direction. Specifically, the check valves ensure that the returned refrigerant can enter the corresponding compression chamber only when the refrigerant already disposed within the compression chamber is at a relatively low pressure that is lower than the pressure of the injected refrigerant. The check valve further prevents an occurrence wherein any compressed refrigerant at a relatively high pressure greater than that of the injected refrigerant flows in reverse (backflows) through the injection opening, through the injection chamber, and towards any components disposed upstream of the injection chamber with respect to the returned refrigerant, such as the aforementioned cyclone separator.

Such check valves may be provided as ball valves that are biased by a spring or the like to a closed position until the injected refrigerant pressure exceeds the pressure of the refrigerant present within the corresponding compression chamber. However, it has been discovered that the use of such ball valves may result in an undesirable pressure drop in the injected refrigerant that reduces the output capacity of the vapor injection scroll compressor. Other shortcomings of such ball valves may be the need for multiple components such that manufacturing complexity is increased, a need for increased axial packaging space for accommodating the motion of the ball relative to the spring, and an inconsistency of the distribution of the injected refrigerant to each of the pair of the injection openings.

Such a check valve may also be provided as a reed valve having a flexible metallic reed that flexes in response to a pressure differential thereacross. However, such reed valves are traditionally provided to include repeated metal to metal contact, which greatly reduces the durability of such reed valves and also introduces a concern of noise, vibration, and harshness (NVH) that can potentially be experienced by a passenger of a vehicle. Moreover, the conventional reed valves are part of a complex injection valve assembly that requires numerous components and complicated sealing structure.

It would therefore be desirable to develop a simplified and durable injection valve assembly for a scroll compressor to minimize manufacturing time and cost, increase discharge chamber volume, and prevent an occurrence of NVH during operation thereof.

SUMMARY

In concordance and agreement with the presently described subject matter, a simplified and durable injection valve assembly for a scroll compressor to minimize manufacturing time and cost, increase discharge chamber volume, and prevent an occurrence of NVH during operation thereof, has surprisingly been designed.

In one embodiment, a valve assembly for a scroll compressor, comprises: a reed structure configured to cooperate with a fixed scroll of the scroll compressor, wherein the reed structure selectively permits a flow of a fluid through at least one of a first injection port and a second injection port of the scroll compressor; a valve member disposed adjacent the reed structure, wherein the valve member includes a first injection aperture and a second injection aperture formed therethrough, and wherein the first injection aperture is in fluid communication with the first injection port of the scroll compressor and the second injection aperture is in fluid communication with the second injection port of the scroll compressor; and a valve gasket disposed adjacent the valve member.

In another embodiment, a valve assembly for a scroll compressor, comprises: a reed structure having a first reed and a second reed, wherein the first reed is configured to be received in a first indentation of a fixed scroll of the scroll compressor and the second reed is configured to be received in a second indentation of a fixed scroll of the scroll compressor; a valve member disposed adjacent the reed structure, wherein the valve member includes a first injection aperture and a second injection aperture formed therethrough, and wherein the first injection aperture is in fluid communication with a first injection port of the scroll compressor and the second injection aperture is in fluid communication with a second injection port of the scroll compressor; and a valve gasket disposed adjacent the valve member.

In yet another embodiment, a scroll compressor, comprises: a compression mechanism including a fixed scroll and an orbit scroll, wherein the fixed scroll includes a recessed pocket having a first injection port and a second injection port formed therein; and a valve assembly coupled to the fixed scroll, the valve assembly comprises: a reed structure at least partially disposed in the recessed pocket of the fixed scroll; a valve member disposed adjacent the reed structure, wherein the valve member includes a first injection aperture and a second injection aperture formed therethrough, and wherein the first injection aperture is in fluid communication with a first injection port of the scroll compressor and the second injection aperture is in fluid communication with a second injection port of the scroll compressor; and a valve gasket disposed adjacent the valve member.

As aspects of some embodiments, the reed structure includes a first reed configured to selectively permit the fluid to flow through the first injection port of the scroll compressor.

As aspects of some embodiments, the reed structure includes a second reed configured to selectively permit the fluid to flow through the second injection port of the scroll compressor.

As aspects of some embodiments, the first injection port is in fluid communication with an injection chamber formed in the scroll compressor.

As aspects of some embodiments, the second injection port is in fluid communication with an injection chamber formed in the scroll compressor.

As aspects of some embodiments, the reed structure includes a first reed configured to selectively permit a flow of fluid through the first injection port of the fixed scroll.

As aspects of some embodiments, the reed structure includes a second reed configured to selectively permit a flow of fluid through the second injection port of the fixed scroll.

As aspects of some embodiments, at least a portion of the reed structure is in direct contact with at least one surface of the fixed scroll of the scroll compressor.

As aspects of some embodiments, the first injection port is located in a first indentation formed in the recessed pocket of the fixed scroll.

As aspects of some embodiments, the second injection port is located in a second indentation formed in the recessed pocket of the fixed scroll.

As aspects of some embodiments, the scroll compressor further comprises a housing portion configured to receive at least a portion of the fixed scroll therein, wherein the valve gasket is configured to provide a substantially fluid-tight seal between the valve member and the housing portion of the scroll compressor.

As aspects of some embodiments, the valve gasket includes a bead formed around a periphery thereof, and wherein the bead is configured to be compressed between the valve member and the housing portion of the scroll compressor.

As aspects of some embodiments, the scroll compressor further comprises a housing portion including an inner wall, wherein the inner wall defines an injection chamber and is configured to cooperate with the valve assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 10:
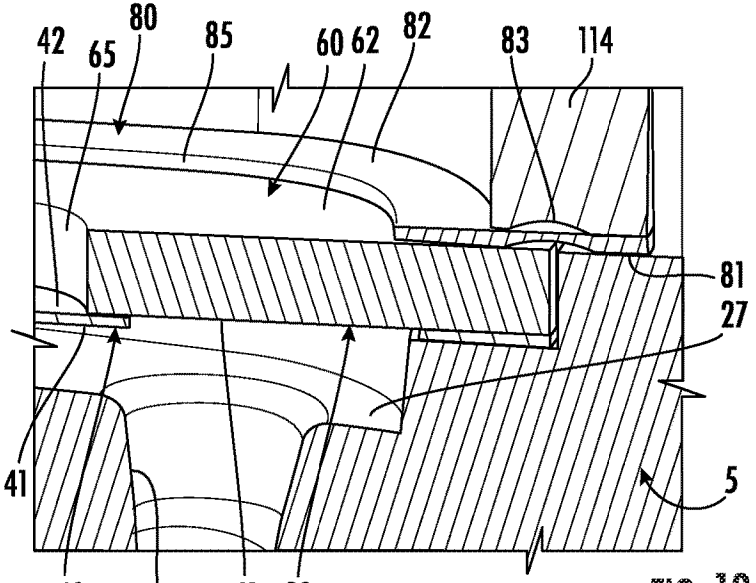
Figure 12:
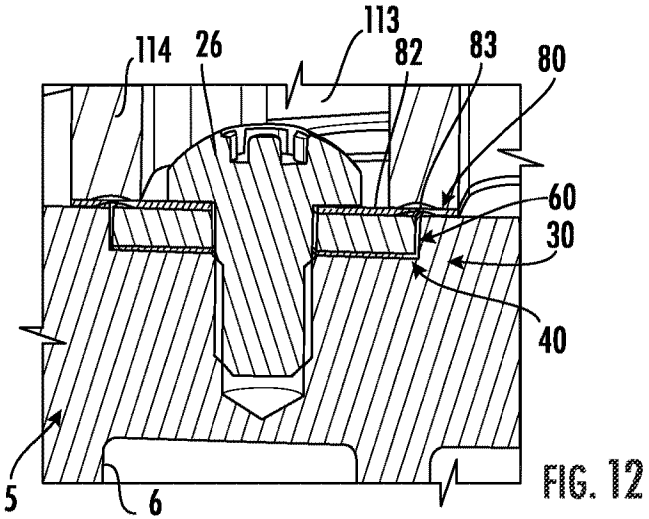
Figure 11:
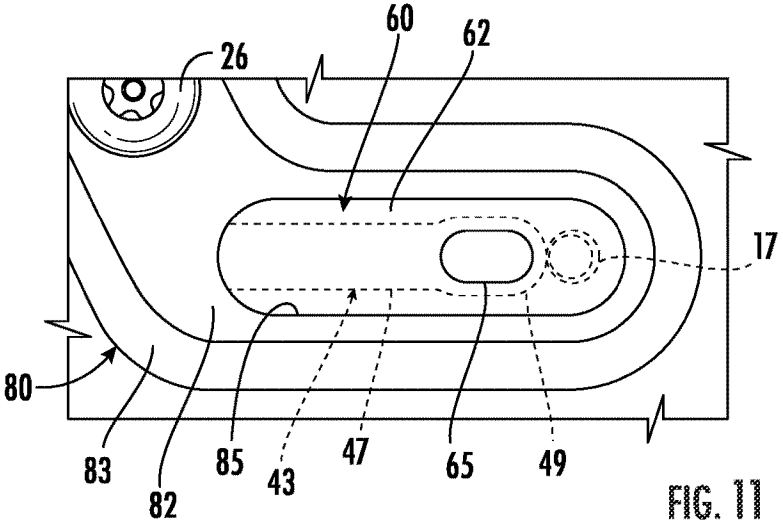

FIG. 10 is an enlarged fragmentary perspective sectional view of a portion of the fixed scroll with the injection valve assembly coupled to the first housing portion of the scroll compressor; and FIG. 11 is an enlarged fragmentary axial end view of a portion of the injection valve assembly coupled to the fixed scroll of the scroll compressor; and FIG. 12 is an enlarged fragmentary perspective sectional view of a portion of the fixed scroll with the injection valve assembly coupled to the first housing portion of the scroll compressor.

DETAILED DESCRIPTION

The following description of technology is merely exemplary in nature of the subject matter, manufacture and use of one or more disclosures, and is not intended to limit the scope, application, or uses of any specific disclosure claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-12 illustrate portions of a vapor injection scroll compressor 1 having an injection valve assembly 30 according to an embodiment of the present disclosure. The scroll compressor 1 may be provided as a component of an HVAC system of a motor vehicle, and more particularly, a component for circulating a refrigerant of an associated refrigerant circuit in heat exchange communication with air to be delivered to the passenger compartment of the associated motor vehicle. The refrigerant may also be in heat exchange relationship with additional components of the motor vehicle in need of heat regulation, such as a battery or other electronic components associated with operation of various different systems of the motor vehicle. References to the refrigerant as used hereinafter may refer to a refrigerant when provided solely as a gas or as a mixture of a gas and a liquid. Although the scroll compressor 1 is described as being utilized for a refrigerant of an HVAC system, it should be apparent that the structure disclosed herein may be adapted for use with any fluid in need of compression with respect to any associated fluid system, as desired.

Figure 1:
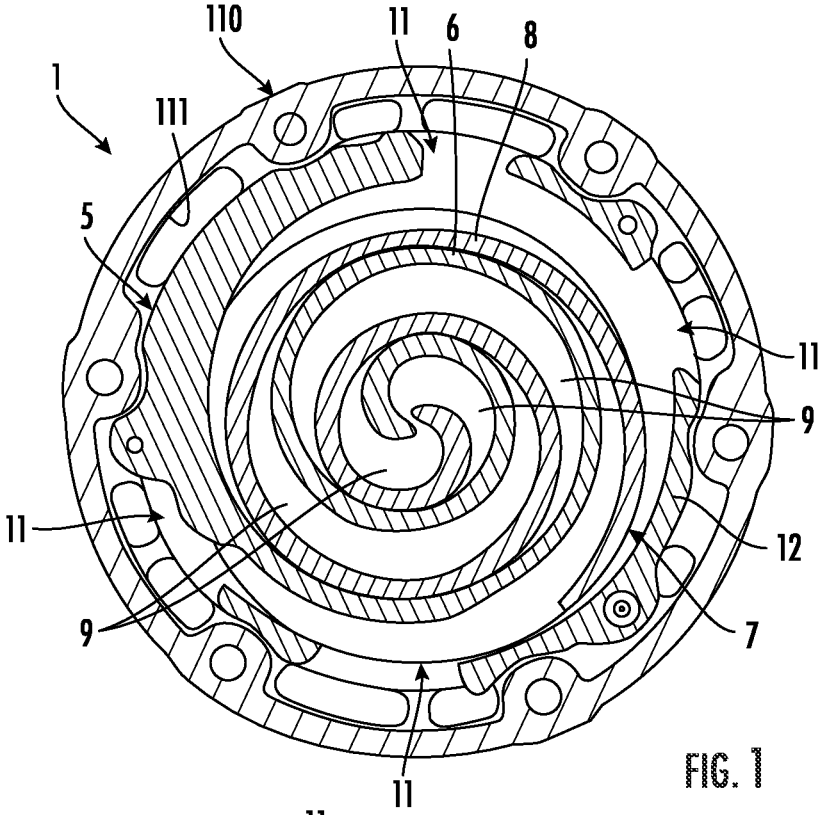
FIG. 1 is a cross-sectional elevational view taken through a compression mechanism of a scroll compressor according to an embodiment of the present disclosure.

As best shown in cross-section in FIG. 1, the scroll compressor 1 includes a compression mechanism formed by a fixed scroll 5 having an axially extending first spiral structure 6 and an orbiting scroll 7 having an axially extending second spiral structure 8. The second spiral structure 8 extends in an opposing axial direction relative to the first spiral structure 6 with each of the spirals of the second spiral structure 8 nested into each of the spaces formed between adjacent spirals of the first spiral structure 6. The first spiral structure 6 and the second spiral structure 8 are positioned relative to each other to form a plurality of compression chambers 9 therebetween during operation of the compression mechanism of the scroll compressor 1.

The fixed scroll 5 includes at least one inlet opening 11 adjacent a radially outermost portion thereof for introducing the refrigerant into each of the compression chambers 9. In the provided embodiment, the fixed scroll 5 includes a plurality of the inlet openings 11 circumferentially spaced apart from each other in an outer circumferential wall 12 of the fixed scroll 5 with each of the inlet openings 11 provided as a hole, indentation, or other form of passageway allowing for radially inward flow of the refrigerant into one of the compression chambers 9. The refrigerant generally enters the fixed scroll 5 through one of the inlet openings 11 at a relatively low pressure typically referred to as a suction pressure of the scroll compressor 1. The fixed scroll 5 further includes a discharge opening 13 formed at a radial innermost end of the first spiral structure 6 through which the refrigerant exits each of the compression chambers 9 after having been compressed therein. The discharge opening 13 is accordingly located at or adjacent a radial center of the fixed scroll 5. The compressed refrigerant thereby exits the cooperating scrolls 5, 7 at a relatively high pressure that is greater than the relatively low pressure suction pressure, wherein the relatively high pressure is referred to as the discharge pressure of the scroll compressor 1. A reed valve assembly comprising a reed valve 2 and a retainer 3 may be employed to selectively permit the compressed refrigerant from the fixed scroll 5. As illustrated, the reed valve assembly may be coupled to the fixed scroll by at least one coupling element 4 (e.g., a mechanical fastener). However, other coupling means may be employed if desired.

The orbiting scroll 7 is configured to orbit relative to the fixed scroll 5 in a manner wherein each of the compression chambers 9 progresses circumferentially and radially inwardly towards the discharge opening 13. A shape and position of each of the compression chambers 9 accordingly changes relative to the fixed shape and position of the fixed scroll 5 during the repeating orbiting motion of the orbiting scroll 7. This motion causes each of the compression chambers 9 to reduce in flow volume as each of the compression chambers 9 approaches the radially inwardly disposed discharge opening 13, thereby causing the previously discussed compression of the refrigerant.

FIG. 1 illustrates the cross-section through the fixed scroll 5 and the orbiting scroll 7 when the compression mechanism is at a position having two pairs of opposing compression chambers 9. Each of the compression chambers 9 forming one of the pairs includes substantially the same shape rotated 180 degrees relative to the other of the paired and opposing compression chambers 9. A first pair of the compression chambers 9 is disposed immediately adjacent a radial center of each of the spiral structures 6, 8 (generally corresponding to the position of the discharge opening 13) while a second pair of the compressions chambers 9 is formed radially outwardly of the first pair of the compression chambers 9 closer to the inlet openings 11.

Figure 2:
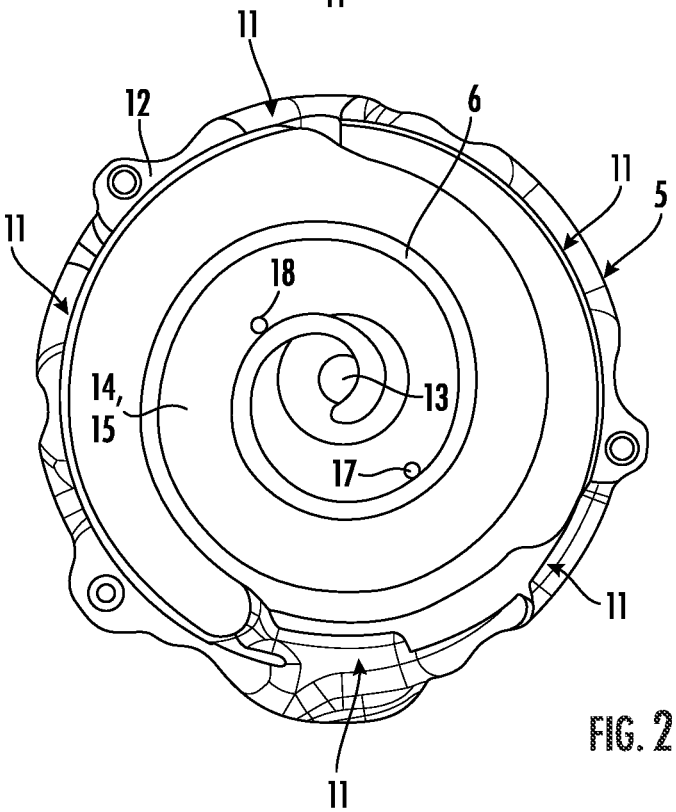
FIG. 2 is an axial end elevational view of a fixed scroll of the compression mechanism of FIG. 1 with the fixed scroll shown in isolation.
Figure 3:
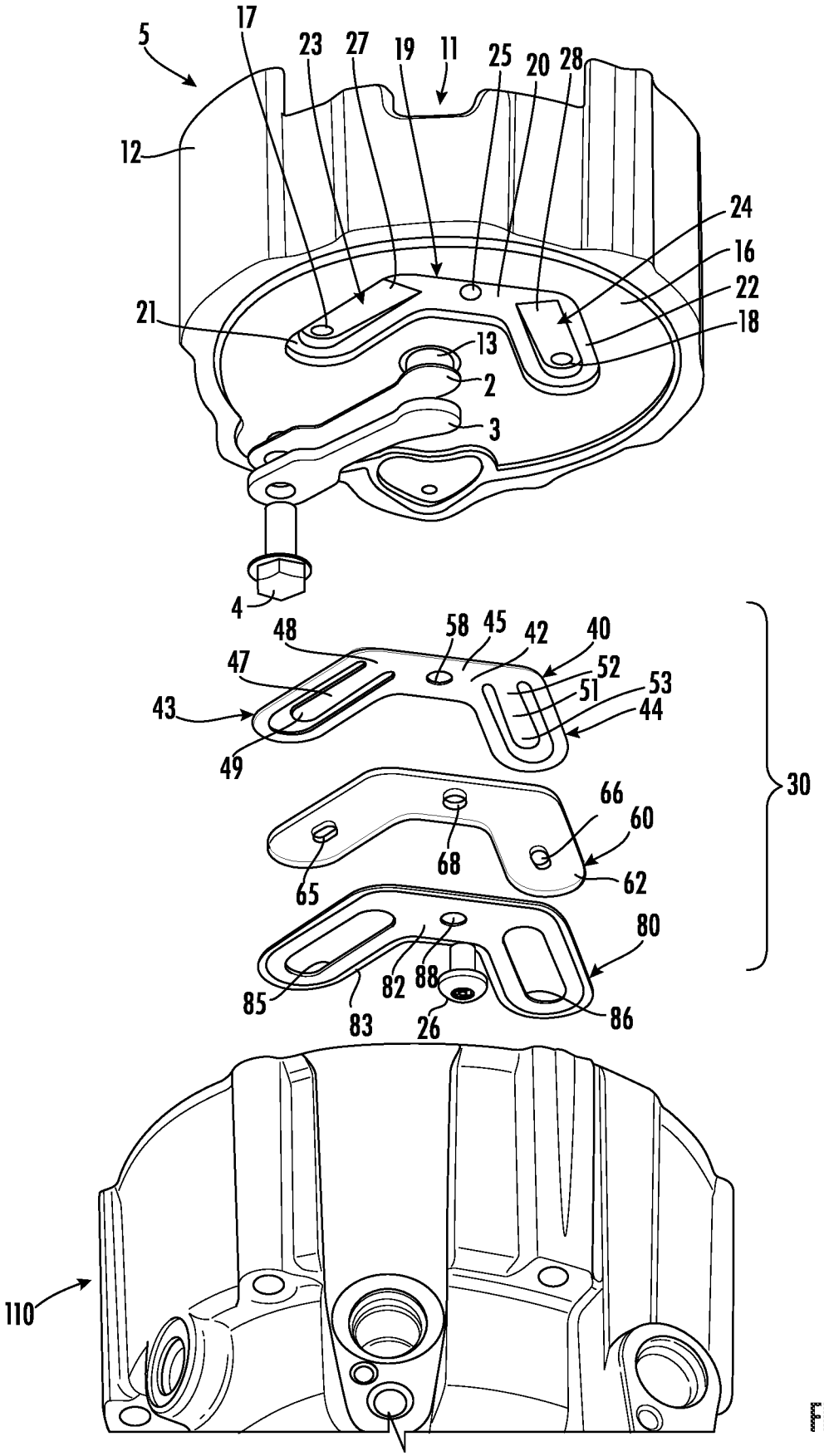
FIG. 3 is an exploded and fragmentary perspective view of relevant components of the scroll compressor necessary for illustrating an injection valve assembly of the scroll compressor.
Figure 4:
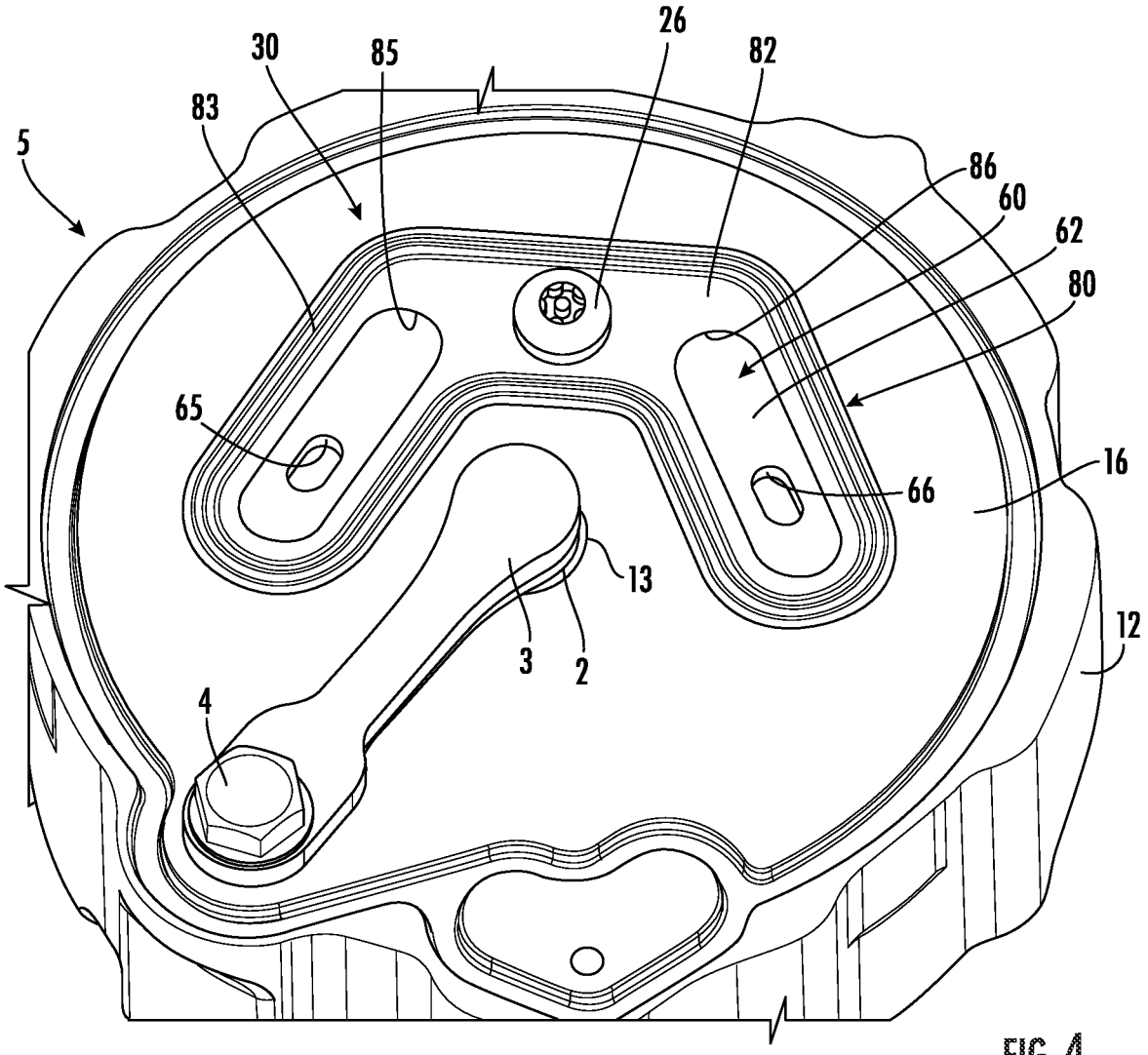
FIG. 4 is fragmentary axial end perspective view of the injection valve assembly coupled to the fixed scroll of the scroll compressor.

The fixed scroll 5 includes an end wall 14 including an inner face 15, shown in FIG. 2, and an opposing outer face 16, shown in FIGS. 3 and 4. The inner face 15 faces towards the orbiting scroll 7 with the first spiral structure 6 extending axially from the inner face 15. The outer face 16 faces away from the orbiting scroll 7 and faces towards the previously mentioned valve assembly 30 (shown in FIG. 3). The discharge opening 13, a first injection port 17, and a second injection port 18 are all formed through the end wall 14 from the inner face 15 to the outer face 16 thereof. FIG. 2 shows the inner face 15 of the end wall 14 with the orbiting scroll 7 omitted to better illustrate the positioning of the discharge opening 13 and the injection ports 17, 18 relative to the configuration of the first spiral structure 6.

Figure 5:
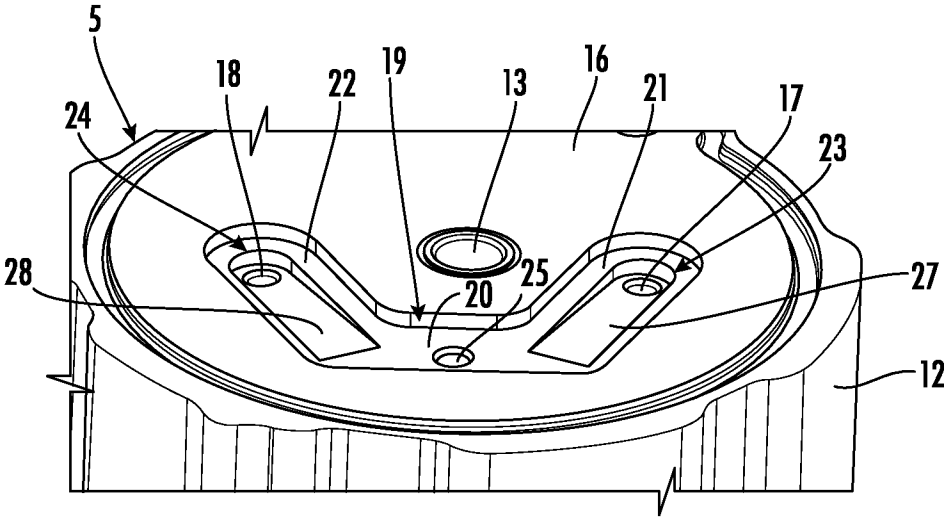
FIG. 5 is a fragmentary axial end perspective view of the fixed scroll of the scroll compressor without the injection valve assembly coupled thereto.
Figure 6:
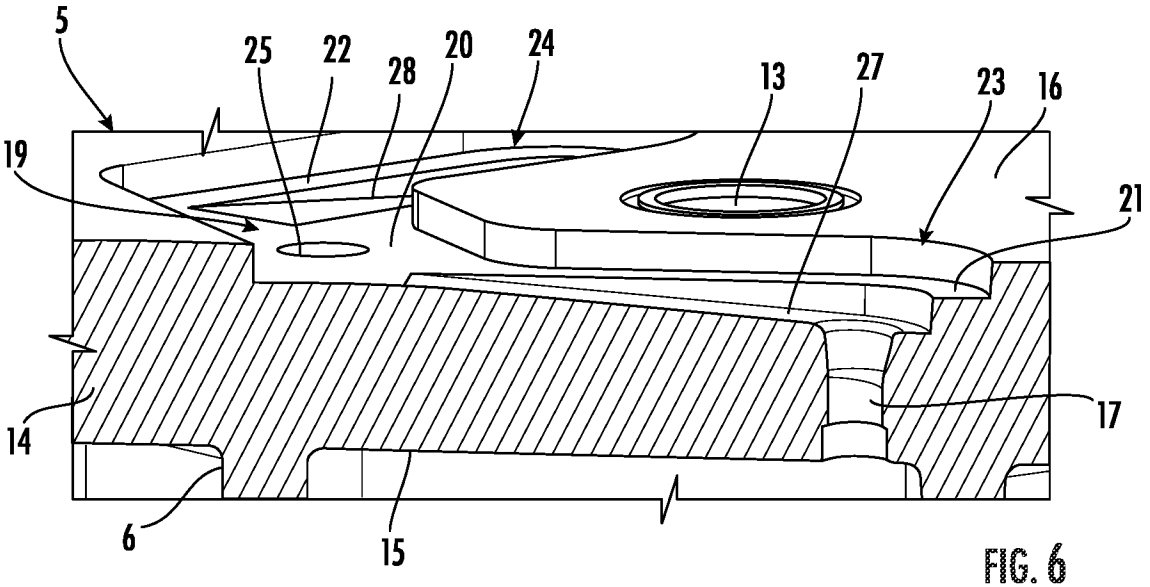
FIG. 6 is a fragmentary sectional view of a portion of the fixed scroll without the injection valve assembly coupled thereto.

A recessed pocket 19 may be formed to axially extend into the outer face 16 of the fixed scroll 5. Although the recessed pocket 19 shown is substantially V-shaped, it is understood that the recessed pocket 19 may have any suitable shape, size, and configuration as desired. In some embodiments, the recessed pocket 19 may be formed by a center portion 20 with opposing leg portions 21, 22 extending outwardly therefrom. As best seen in FIGS. 5 and 6, the outer face 16 of the fixed scroll 5 further includes a first indentation 23 and a spaced apart indentation 24. The indentations 23, 24 are formed in the leg portions 21, 22, respectively, of the recessed pocket 19. Each of the indentations 23, 24 is defined by respective surfaces 27, 28 inclined at an angle relative to a plane of the outer face 16 of the fixed scroll 5. An axial depth of each of the indentations 23, 24 gradually increases as the indentations 23, 24 extend away from the center portion 20 into the leg portions 21, 22. An angle of inclination of the surfaces 27, 28 may be about 3-5 degrees. It is understood that the surfaces 27, 28 may have any suitable angle of inclination as desired. An opening 25 may also be formed in the recessed pocket 19, and more particularly in the center portion 20 thereof. The opening 25 may be configured to receive a coupling element 26 (e.g., a mechanical fastener) to couple the valve assembly 30 to the fixed scroll 5.

As shown in FIGS. 3, 5, and 6, each of the injection ports 17, 18 is formed in a respective one of the indentations 23, 24 of the outer face 16. The first injection port 17 is positioned substantially opposite the second injection port 18 relative to the centrally disposed discharge opening 13, with each of the injection ports 17, 18 also spaced radially at a substantially equal distance from the discharge opening 13. The substantially opposite positioning of the injection ports 17, 18 allows for the first injection port 17 to fluidly communicate with a first one of each of the oppositely paired compression chambers 9 and the second injection port 18 to fluidly communicate with a second one of each of the oppositely paired compression chambers 9. As such, each of the compression chambers 9 progressing radially inwardly towards the discharge opening 13 is able to fluidly communicate with one of the injection ports 17, 18 at a substantially similar radial position relative to the discharge opening 13, which also corresponds to the refrigerant disposed within each of the opposing and paired compression chambers 9 having a similar pressure when fluidly communicating with the corresponding one of the injection ports 17, 18. The pressure of the refrigerant when reaching each of the injection ports 17, 18 may be referred to as an intermediate pressure having a value between the previously described suction pressure and discharge pressure.

Referring now to FIG. 3, the components of the scroll compressor 1 relevant to the operation of the valve assembly 30 are shown in exploded view for more easily ascertaining the method of assembly thereof. The orbiting scroll 7 and the components necessary for causing the orbiting motion thereof are omitted, but one skilled in the art should readily appreciate that the method of operation of the valve assembly 30 is apparent from the illustrated perspective in their absence.

A first housing portion 110 of the scroll compressor 1 is an open ended and hollow structure configured to mate with a second housing portion (not shown) of the scroll compressor 1 for enclosing the internal components thereof. The first housing portion 110 defines a housing cavity 111 configured to receive the fixed scroll 5 and the valve assembly 30 therein. It should be appreciated that alternative configurations of the housing components of the scroll compressor 1 may be provided so long as the relevant structures for directing the flow of the refrigerant are maintained as described hereinafter, including the use of additional housing components or the use of housing components having alternatively arranged joints present therebetween. More specifically, any combination of housing components may be utilized so long as the housing cavity 111 is provided to receive the fixed scroll 5 and the valve assembly 30 therein in a manner promoting operation of the valve assembly 30 as disclosed hereinafter.

The housing cavity 111 is in fluid communication with a refrigerant return passage 112. The refrigerant return passage 112 provides fluid communication between the housing cavity 111 and another component (not shown) of the associated refrigerant circuit through which the refrigerant is passed after being initially compressed within the compression mechanism of the scroll compressor 1. For example, the component may be a separator (not shown) disposed downstream of the compression mechanism and upstream of a low pressure side of the scroll compressor 1 with respect to a general direction of flow of the refrigerant through the refrigerant circuit, such as a cyclone separator. The refrigerant return passage 112 is configured to receive a partial flow of the refrigerant after branching away from the refrigerant circuit. The partial flow of the refrigerant may have a pressure between the discharge pressure and the suction pressure and may bypass at least one component of the refrigerant circuit disposed upstream of the low pressure side of the scroll compressor 1. In some instances, the component from which the refrigerant branches back towards the refrigerant return passage 112 may be disposed immediately downstream of the compression mechanism and even from a downstream arranged portion of the scroll compressor 1 itself. It is understood that the refrigerant may return to the refrigerant return passage 112 from any component of the refrigerant circuit while remaining within the scope of the present disclosure so long as the refrigerant has the required characteristics for being injected back into the compression chambers 9 during the compression process occurring within the compression mechanism.

Figure 8:
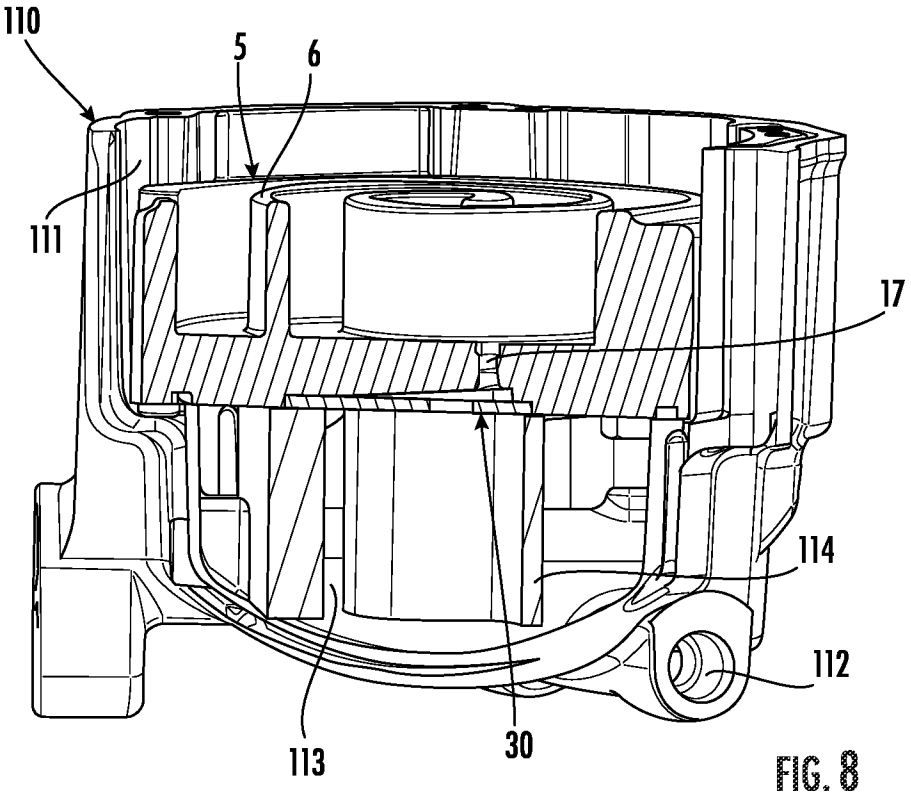
FIG. 8 is a perspective sectional view of the fixed scroll coupled to the first housing portion of the scroll compressor.
Figure 7:
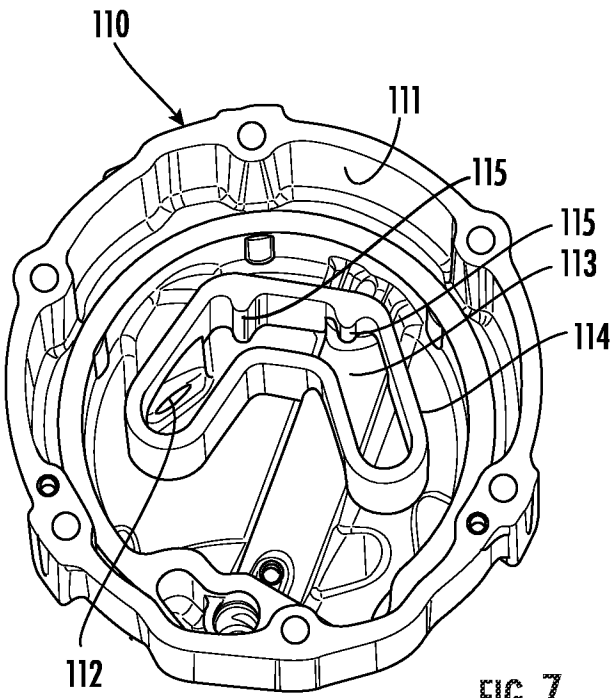
FIG. 7 is an axial end perspective view of a first housing portion of the scroll compressor having a wall defining an injection chamber.

As illustrated in FIGS. 7 and 8, the refrigerant return passage 112 leads to an injection chamber 113 of the first housing portion 110. The injection chamber 113 is an open space defined by an axially extending inner wall 114 formed in the housing cavity 111 between the refrigerant return passage 112 and the valve assembly 30. The refrigerant entering the injection chamber 113 may be a gaseous vapor or a combination of a gaseous vapor and a liquid, depending on the circumstances of the returned refrigerant. As illustrated, the wall 114 may be configured to correspond to a shape, size, and configuration of the valve assembly 30 and may include one or more protrusions 115 extending inwardly into the injection chamber 113. Although the protrusions 115 shown have a generally lobed or tongue shape, it is understood that each of the protrusions 115 may have any shape, size, and configuration as desired. For example, the protrusions 115 may each have a generally rectangular shape with a squared end or an entirely irregular shape.

Referring back to FIG. 3, the valve assembly 30 includes a double reed structure 40, a valve member 60, and a valve gasket 80. A direction of assembly of the valve assembly 30 as shown by the direction of separation of the components forming the valve assembly 30 in the exploded view of FIG. 3 is hereinafter referred to as an axial direction of the valve assembly 30. The axial direction of the valve assembly 30 also corresponds to the axial direction of each of the constituent components thereof as used hereinafter.

Figure 9:
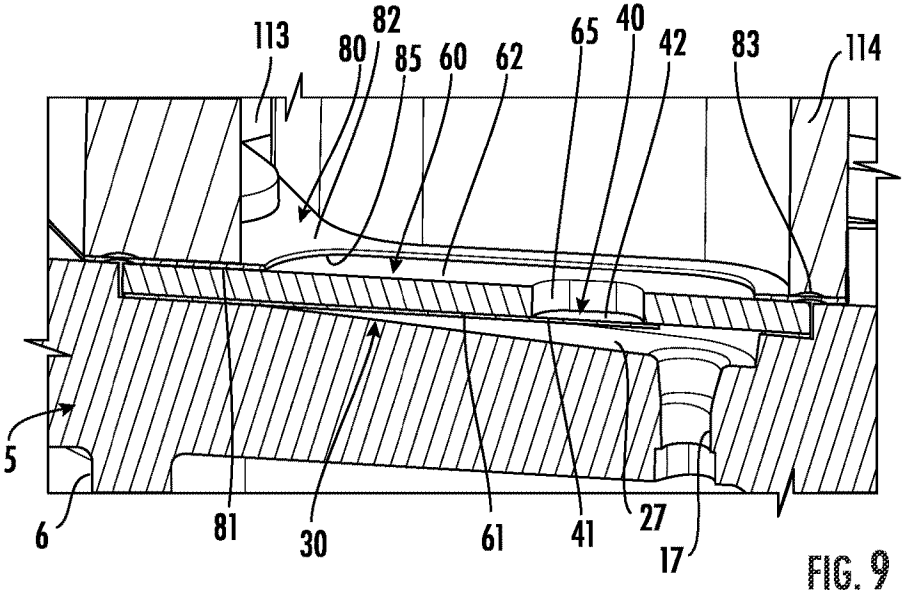
FIG. 9 is a fragmentary perspective sectional view of a portion of the fixed scroll with the injection valve assembly coupled to the first housing portion of the scroll compressor.

The double reed structure 40 is a thin and planar plate-like body including a first major surface 41 and an oppositely arranged second major surface 42 (best shown in FIGS. 9 and 10). The major surfaces 41, 42 are arranged parallel to each other and perpendicular to the axial direction of the valve assembly 30. The first major surface 41 is configured to abut a surface of the recessed pocket 19 and the second major surface 42 is configured to abut the valve member 60 as explained in greater detail hereinafter.

The double reed structure 40 includes a first reed 43, a second reed 44, and a connecting portion 45. The reeds 43, 44 and the connecting portion 45 are integrally formed as one monolithic structure. It is understood, however, that the reed structure 40 may comprise multiple parts if desired. The first reed 43 and the second reed 44 may extend longitudinally away from the connecting portion 45 in generally opposing directions perpendicular to the axial direction of the valve assembly 30 when the reeds 43, 44 are not flexed during operation of the scroll compressor 1. In the provided embodiment, the reeds 43, 44 and the connecting portion 45 are formed to have a substantially V-shaped configuration, but each of the reeds 43, 44 and the connecting portion 45 may have any shape, size, and configuration so long as the reed structure 40 may be received in the recessed pocket 19 of the fixed scroll 5 and/or the connecting portion 45 extends between and connects the reeds 43, 44 to form the described unitary structure with the reeds 43, 44. As such, the wall 114 of the first housing portion 110 may also have a substantially V-shaped configuration corresponding to the shape, size, and configuration of the reed structure 40.

The first reed 43 includes an arm 47 extending longitudinally between a pivot portion 48 and an end portion 49. The pivot portion 48 forms an axis about which the remainder of the first reed 43 (including the end portion 49 disposed at a distal end of the arm 47 opposite the pivot portion 48) flexes relative to the stationary connecting portion 45. As shown in FIGS. 3, 9, and 11, the end portion 49 is disposed in alignment with a first injection aperture 65 of the valve member 60 with respect to the axial direction of the valve assembly 30. The arm 47 may include a substantially rectangular shape while the end portion 49 may include a substantially curved perimeter shape. For example, the end portion 49 may include an elliptical shape, oval shape, rounded rectangular shape, or the like, to ensure that the end portion 49 is capable of covering the first injection aperture 65 when engaging the valve member 60 around a periphery of the first injection aperture 65.

The second reed 44 includes an arm 51 extending longitudinally between a pivot portion 52 and an end portion 53. The pivot portion 52 forms an axis about which the remainder of the second reed 44 (including the end portion 53 disposed at a distal end of the arm 51 opposite the pivot portion 52) flexes relative to the stationary connecting portion 45. As illustrated in FIG. 3, the end portion 53 is disposed in alignment with a second injection aperture 66 of the valve member 60 with respect to the axial direction of the valve assembly 30. The arm 51 may include a substantially rectangular shape while the end portion 53 may include a substantially curved perimeter shape. For example, the end portion 53 may include an elliptical shape, oval shape, rounded rectangular shape, or the like, to ensure that the end portion 53 is capable of covering the second injection aperture 66 when engaging the valve member 60 around a periphery of the second injection aperture 66.

The double reed structure 40 further includes an opening 58 disposed in the connecting portion 45. The opening 58 is formed in alignment with the opening 25 formed in the recessed pocket 19 of the fixed scroll 5. The opening 58 is configured to receive the coupling element 26 therethrough when the valve assembly 30 is in the assembled configuration to properly position the double reed structure 40 relative to the fixed scroll 5 and/or the wall 114. In certain embodiments, the protrusions 115 of the wall 114 ensure that the reed structure 40 may be clamped and/or supported for control of the respective pivot portions 48, 52 of the reeds 43, 44. A stiffness of the each of the reeds 43, 44 of the reed structure 40 may be inversely related to a pivot length of the reeds 43, 44. In certain embodiments, a location of the pivot portions 48, 52 and/or the pivot length of the reeds 43, 44 may be controlled by a size, shape, and configuration of the protrusions 115 of the wall 114. For example, an increase in an inward extension of the protrusions 115 into the injection chamber 113 may move the location of the pivot portions 48, 52 towards the end portions 49, 53 resulting in a shorter pivot length of the reeds 43, 44, and thereby a stiffer reed structure 40. Conversely, a decrease in the inward extension of the protrusions 115 into the injection chamber 113 may move the location of the pivot portions 48, 52 away from the end portions 49, 53 resulting in a longer pivot length of the reeds 43, 44, and thereby a more flexible reed structure 40.

The double reed structure 40 is formed from a resiliently flexible material allowing for each of the arms 47, 51 of the reeds 43, 44 to flex about the respective pivot portions 48, 52 away from the plane generally defined by the double reed structure 40. The resiliently flexible material is selected to allow for repeated elastic deformations of each of the reeds 43, 44 about the pivot portions 48, 52 while still allowing for each of the reeds 43, 44 to spring back to the original positions thereof wherein the reeds 43, 44 are arranged substantially perpendicular to the axial direction of the valve assembly 30 and parallel to the major surfaces 41, 42 of the connecting portion 45 of the double reed structure 40. The flexing of each of the reeds 43, 44 away from the corresponding injection aperture 17, 18 requires a force being applied to each of the reeds 43, 44 that overcomes a spring force generated by the resiliency of each of the reeds 43, 44 at each of the corresponding pivot portions 48, 52. The double reed structure 40 may accordingly be formed from a suitable metallic material such as aluminum, steel, or alloys thereof.

As shown in FIGS. 3 and 9-12, the valve member 60 may be disposed in the recessed pocket 19 of the fixed scroll 5 and includes a substantially planar first major surface 61 and an oppositely arranged and also substantially planar second major surface 62, wherein the major surfaces 61, 62 are arranged parallel to each other and perpendicular to the axial direction of the valve assembly 30. The first major surface 61 faces towards the double reed structure 40 and the second major surface 62 faces towards the refrigerant return passage 112 and the valve gasket 80. In some embodiments, the valve member 60 is seated in the recessed pocket 19 of the fixed scroll 5 adjacent the reed structure 40. Preferably, the second major surface 62 of the valve member 60 and the outer face 16 of the fixed scroll 5 are substantially coplanar when the valve member 60 assembled with the fixed scroll 5.

The valve member 60 includes a first injection aperture 65 and a spaced apart second injection aperture 66. Each of the injection apertures 65, 66 extends through the valve member 60 with respect to the axial direction from the first major surface 61 to the second major surface 62 thereof. A spacing between the injection apertures 65, 66 with respect to a direction perpendicular to the axial direction may be substantially similar to or equal to a spacing between the first injection port 17 and the second injection port 18 formed through the fixed scroll 5. Each of the injection apertures 65, 66 is in fluid communication with a respective one of the injection ports 17, 18. In some embodiments, the first injection aperture 65 is in fluid communication with the first injection port 17 and the second injection aperture 66 is in fluid communication with the second injection port 18.

Each of the injection apertures 65, 66 is shown as having an elongated perimeter shape with a direction of elongation of each of the injection apertures 65, 66 arranged in parallel. The injection apertures 65, 66 may otherwise be referred to as injection slots 65, 66 due to the elongated configurations thereof. Each of the injections holes 65, 66 is shown as having an elongate shape, but other rounded and elongate shapes may be utilized such as an elliptical shape, oval shape, rounded rectangular shape, or the like. The elongate shape of each of the injection apertures 65, 66 beneficially provides for an increased cross-sectional flow area therethrough in comparison to a purely circular cross-sectional shape, which in turn increases the total force that can be applied by the returned refrigerant through each of the injection apertures 65, 66 with respect to a given pressure of the refrigerant. However, other shapes, including the circular shape, may be utilized while still appreciating the remaining beneficial characteristics of the valve assembly 30.

The valve member 60 further includes an opening 68 formed therethrough. The opening 68 is formed in alignment with the openings 25, 58 formed in the recessed pocket 19 of the fixed scroll 5 and the double reed structure 40, respectively. The opening 68 is configured to receive the coupling element 26 therethrough when the valve assembly 30 is in the assembled configuration to properly position the double reed structure 40 and the valve member 60 relative to the fixed scroll 5.

As best seen in FIGS. 9-10 and 12, the valve gasket 80 is disposed between a periphery of the second major surface 62 of the valve member 60 and an inner surface of the wall 114 defining the injection chamber 113. The valve gasket 80 has a first major surface 81 and a second major surface 82. The second major surface 82 further includes a bead 83 projecting axially from a periphery thereof with the bead 83 configured to sealingly engage the wall 114 of the first housing portion 110. The bead 83 engages the wall 114 peripherally to surround the injection chamber 113. The fixed scroll 5 is received into the housing cavity 111 with the bead 81 compressed between the second major surface 62 of the valve member 60 and the wall 114 for creating a substantially fluid-tight seal in a manner to isolate the injection chamber 113 and the valve assembly 30 from the low pressure side of the scroll compressor 1. A compression of the valve gasket 80 is achieved by a clamping force resulting from a coupling of the fixed scroll 5 to the first housing portion 110. In some embodiments, the fixed scroll 5 is coupled to the first housing portion 110 by one or more fasteners (e.g., head bolts).

The valve gasket 80 further includes a first injection aperture 85 and a spaced apart second injection aperture 86. Each of the injection apertures 85, 86 extends through the valve gasket 80 with respect to the axial direction from the first major surface 81 to the second major surface 82 thereof. Each of the injection apertures 85, 86 is in fluid communication with a respective one of the injection apertures 65, 66 of the valve member 60 and/or the injection chamber 113. In some embodiments, the first injection aperture 85 is in fluid communication with the first injection aperture 65 of the valve member 60 and the second injection aperture 86 is in fluid communication with the second injection aperture 66 of the valve member 60. Accordingly, the injection chamber 113 is in fluid communication with the first injection port 17 via the injection apertures 65, 85 and in fluid communication with the second injection port 18 via the injection apertures 66, 86.

Each of the injection apertures 85, 86 is shown as having an elongated perimeter shape with a direction of elongation of each of the injection apertures 85, 86 arranged in parallel. The injection apertures 85, 86 may otherwise be referred to as injection slots 85, 86 due to the elongated configurations thereof. Each of the injections apertures 85, 86 is shown as having an elongate shape, but other rounded and elongate shapes may be utilized such as an elliptical shape, oval shape, rounded rectangular shape, or the like. The elongate shape of each of the injection apertures 85, 86 beneficially provides for an increased cross-sectional flow area therethrough in comparison to a purely circular cross-sectional shape, which in turn increases the total force that can be applied by the returned refrigerant through each of the injection apertures 85, 86 with respect to a given pressure of the refrigerant. However, other shapes, including the circular shape, may be utilized while still appreciating the remaining beneficial characteristics of the valve assembly 30.

The valve gasket 80 further includes an opening 88 formed therethrough. The opening 88 is formed in alignment with the openings 25, 58, 68 formed in the recessed pocket 19 of the fixed scroll 5, the double reed structure 40, and the valve member 60, respectively. The opening 88 is configured to receive the coupling element 26 therethrough when the valve assembly 30 is in the assembled configuration to properly position the double reed structure 40, the valve member 60, and the valve gasket 80 relative to the fixed scroll 5.

At least a portion of the valve gasket 80 may be formed from a resiliently compressible material suitable for sealingly engaging each of the corresponding surfaces of the valve member 60 and the wall 114 of the first housing portion 110, as described above. The valve gasket 80 may be formed from metal material and/or a non-metal material (e.g., a polymeric material, an elastomer), as desired.

Operation of the valve assembly 30 is now described. Because the flow configuration of the refrigerant is substantially identical with respect to each of the partial refrigerant flows entering each of the injection ports 17, 18, only the partial refrigerant flow passing from the injection chamber 113 formed in the housing portion 110 to the first injection port 17 is described in detail hereinafter with the understanding that the corresponding and analogous components associated with the other partial refrigerant flow passing from the injection chamber 113 to the second injection port 18 operate in the same manner.

During operation of the scroll compressor 1, at least a portion of the refrigerant discharged from the compression mechanism formed by the cooperating scrolls 5, 7 is returned back to the injection chamber 113 via the refrigerant return passage 112. The end portion 49 of the first reed 43 is configured to normally extend across and cover the first injection aperture 65 of the valve member 60 to prevent undesired flow of the returned refrigerant from the injection chamber 113 and towards the first injection port 17. The compression mechanism of the scroll compressor 1 operates to cause the first injection port 17 to repeatedly experience a variable pressure of the refrigerant within the compression mechanism depending on the progression of each subsequent compression chamber 9 passing by the first injection port 17.

When the variable pressure experienced by the first injection port 17 from the refrigerant originating from within the compression mechanism is relatively high, the end portion 49 of the first reed 43 is maintained against the surface of the valve member 60 surrounding the first injection aperture 65 to continue to prevent the passage of the refrigerant within the injection chamber 113 towards the first injection port 17. However, when the variable pressure experienced by the first injection port 17 from the refrigerant originating from within the compression mechanism is relatively low, the pressure of the refrigerant within the injection chamber 113 eventually exceeds the relatively low pressure originating from the compression mechanism and a pressure differential is established across the opposing surfaces of the end portion 49 of the first reed 43. When the force of the pressure of the refrigerant within the injection chamber 113 exceeds the combined force of the pressure of the refrigerant originating from the compression mechanism and a spring force generated by a resiliency of the first reed 43 at the pivot portion 48 thereof, the first reed 43 pivots about the axis defined by the pivot portion 48 and towards the first indentation 23 formed in the recessed pocket 19 of the fixed scroll 5. The pivoting of the first reed 43 causes the refrigerant within the injection chamber 113 to pass through the first injection aperture 85 of the valve gasket 80, through the first injection aperture 65 of the valve member 60, and around the now axially spaced end portion 49 of the first reed 43 through the open space formed by the first indentation 23 to the first injection port 17. The refrigerant is then injected into the corresponding compression chamber 9 while having a higher pressure than the refrigerant already disposed within the compression chamber 9 and originating from one of the inlet openings 11 of the fixed scroll 5, which allows for the compression capacity of the scroll compressor 1 to be increased by reintroducing higher pressure refrigerant into the compression mechanism at an intermediate position of the compression process.

The first reed 43 eventually resiliently springs back to the position blocking flow from the injection chamber 113 through the valve assembly 30 based on the cycling of the compression mechanism and the resulting pressure differential on the opposing sides of the first reed 43. The valve assembly 30 accordingly acts a check valve for preventing a flow of the refrigerant in an undesired direction relative to the first reed 43, which in turn prevents the refrigerant originating from the compression mechanism back-flowing into the injection chamber 113 in an undesired flow direction. The described process is repeatedly performed as the pressure experienced by the first injection port 17 is varied with respect to each passing compression chamber 9 formed by the orbiting of the orbiting scroll 7 relative to the fixed scroll 5.

The valve assembly 30 as shown and described offers numerous advantageous features. As is apparent from FIGS. 3-12, the valve assembly 30 is simple and compact in design requiring fewer component than conventional check valves. The recessed pocket 19 in the fixed scroll 5, the unitary formation of the double reed structure 40, and the integral injection chamber 113 formed in the housing portion 110 simplifies the manufacturing and reduces the cost of the valve assembly 30. Sealing between the injection chamber 113 and a discharge chamber formed in the housing portion 110 is achieved by the single valve gasket 80. Additionally, the valve assembly 30 and/or the corresponding wall 114 allows for a smaller injection chamber 113 and an increase in a volume of a discharge chamber formed in the housing portion 110, which in turn results in discharge pulsation noise reduction.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A valve assembly for a scroll compressor, comprising:

a reed structure configured to cooperate with a fixed scroll of the scroll compressor, wherein the reed structure selectively permits a flow of a fluid through at least one of a first injection port and a second injection port into a compression mechanism of the scroll compressor;

a valve member disposed adjacent the reed structure, wherein the valve member includes a first injection aperture and a second injection aperture formed therethrough, and wherein the first injection aperture is in fluid communication with the first injection port of the scroll compressor and the second injection aperture is in fluid communication with the second injection port of the scroll compressor;

a valve gasket disposed adjacent the valve member, wherein the valve gasket includes a bead formed around a periphery thereof, and wherein the bead is configured to be compressed between the valve member and a housing portion of the scroll compressor; and an axially extending inner wall formed in a housing cavity, the bead engaging the inner wall peripherally, wherein the inner wall separates an injection chamber formed in the housing portion and a discharge chamber formed in the housing portion.

2. The valve assembly of claim 1, wherein the reed structure includes a first reed configured to selectively permit the fluid to flow through the first injection port of the scroll compressor.

3. The valve assembly of claim 2, wherein the reed structure includes a second reed configured to selectively permit the fluid to flow through the second injection port of the scroll compressor.

4. The valve assembly of claim 1, wherein at least one of the first injection port and the second injection port is in fluid communication with the injection chamber.

5. The valve assembly of claim 1, wherein at least a portion of the reed structure is in direct contact with at least one surface of the fixed scroll of the scroll compressor.

6. The valve assembly of claim 1, wherein the valve gasket is configured to provide a substantially fluid-tight seal between the valve member and the housing portion of the scroll compressor.

7. A scroll compressor, comprising:

a compression mechanism including a fixed scroll and an orbit scroll, wherein the fixed scroll includes a discharge port, a first injection port, and a second injection port formed therein;

a first valve assembly coupled to the fixed scroll configured to selectively permit a flow of a fluid from the compression mechanism through the discharge port; and a second valve assembly coupled to the fixed scroll configured to selectively permit a flow of the fluid from an injection chamber through at least one of the first injection port and the second injection port, the valve assembly comprising:

a reed structure having a first reed and a second reed, wherein the first reed is configured to be received in a first indentation of the fixed scroll of the compression mechanism and the second reed is configured to be received in a second indentation of the fixed scroll of the compression mechanism;

a valve member disposed adjacent the reed structure, wherein the valve member includes a first injection aperture and a second injection aperture formed therethrough, and wherein the first injection aperture is in fluid communication with the first injection port of the compression mechanism and the second injection aperture is in fluid communication with the second injection port of the compression mechanism; and a valve gasket disposed adjacent the valve member, wherein the valve gasket includes a bead formed around a periphery thereof, and wherein the bead is configured to be compressed between the valve member and a housing portion of the scroll compressor; and an axially extending inner wall formed in a housing cavity, the bead engaging the inner wall peripherally, wherein the inner wall separates the injection chamber and a discharge chamber formed in the housing portion.

8. The scroll compressor of claim 7, wherein the first reed is configured to selectively permit a flow of the fluid through the first injection port into the compression mechanism of the scroll compressor.

9. The scroll compressor of claim 7, wherein the second reed is configured to selectively permit a flow of the fluid through the second injection port into the compression mechanism of the scroll compressor.

10. The scroll compressor of claim 7, wherein the first injection port is located in the first indentation of the fixed scroll.

11. The scroll compressor of claim 7, wherein the second injection port is located in the second indentation of the fixed scroll.

12. A scroll compressor, comprising:

a compression mechanism including a fixed scroll and an orbit scroll, wherein the fixed scroll includes a discharge port and a recessed pocket having a first injection port and a second injection port formed therein;

a first valve assembly coupled to the fixed scroll configured to selectively permit a flow of a fluid through the discharge port into a discharge chamber of the scroll compressor; and a second valve assembly coupled to the fixed scroll, the valve assembly comprising:

a reed structure at least partially disposed in the recessed pocket of the fixed scroll;

a valve member disposed adjacent the reed structure, wherein the valve member includes a first injection aperture and a second injection aperture formed therethrough, wherein the first injection aperture is in fluid communication with the first injection port of the fixed scroll and the second injection aperture is in fluid communication with the second injection port of the fixed scroll, and wherein the reed structure includes at least one reed configured to selectively permit a flow of the fluid through at least one of the first injection port and the second injection port of the fixed scroll into the compression mechanism of the scroll compressor; and a valve gasket disposed adjacent the valve member, a housing portion configured to receive at least a portion of the fixed scroll therein, wherein the valve gasket is configured to provide a substantially fluid-tight seal between the valve member and the housing portion of the scroll compressor, wherein the valve gasket includes a bead formed around a periphery thereof, and wherein the bead is configured to be compressed between the valve member and the housing portion of the scroll compressor; and an axially extending inner wall formed in a housing cavity, the bead engaging the inner wall peripherally, wherein the inner wall separates an injection chamber formed in the housing portion and the discharge chamber.

13. The scroll compressor of claim 12, wherein the first injection port is located in a first indentation formed in the recessed pocket of the fixed scroll.

14. The scroll compressor of claim 12, wherein the second injection port is located in a second indentation formed in the recessed pocket of the fixed scroll.

15. The scroll compressor of claim 12, wherein at least one of the first injection port and the second injection port is in fluid communication with the injection chamber.

16. The scroll compressor of claim 12, wherein the inner wall defines the injection chamber and is configured to cooperate with the valve assembly.

* * * * *